US007417522B2

(12) United States Patent
Sung et al.

(10) Patent No.: US 7,417,522 B2
(45) Date of Patent: Aug. 26, 2008

(54) HIGH VOLTAGE TRANSFORMER

(75) Inventors: Ki-Bong Sung, Goyang-si (KR); Jong-Lae Park, Seoul (KR)

(73) Assignee: Poskom Co., Ltd., Gyeonggi-Do (KR)

( * ) Notice: Subject to any disclaimer, the term of this patent is extended or adjusted under 35 U.S.C. 154(b) by 0 days.

(21) Appl. No.: 11/876,697

(22) Filed: Oct. 22, 2007

(65) Prior Publication Data

US 2008/0094161 A1 Apr. 24, 2008

(30) Foreign Application Priority Data

Oct. 24, 2006 (KR) ..... 10-2006-0103603

(51) Int. Cl.
*H01F 27/28* (2006.01)

(52) U.S. Cl. ..... 336/180

(58) Field of Classification Search ..... 336/65, 336/83, 170, 173, 180–186, 220, 221–223; 363/21.03–9

See application file for complete search history.

(56) References Cited

U.S. PATENT DOCUMENTS 5,349,157 A * 9/1994 Blankenship ..... 219/130.32
5,555,494 A * 9/1996 Morris ..... 363/17
5,694,304 A * 12/1997 Telefus et al. ..... 363/21.03
5,712,772 A * 1/1998 Telefus et al. ..... 363/21.02

* cited by examiner

*Primary Examiner*—Tuyen T. Nguyen
(74) *Attorney, Agent, or Firm*—Lowe Hauptman Ham & Berner

(57) ABSTRACT

A high voltage transformer is small-sized, lightweight and less costly to fabricate. The high voltage transformer is designed to maintain equal the potential difference between the components of two transforming component groups and also to keep the components of the respective transforming component groups equipotential at the same distance in the direction extending from a first end to a second end. This eliminates the need to dispose an insulating body between the components of the first and second transforming component groups. This also makes it possible to fabricate the high voltage transformer with a small size and in a cost-effective manner.

5 Claims, 4 Drawing Sheets

HIGH VOLTAGE TRANSFORMER

CROSS-REFERENCE TO RELATED PATENT APPLICATION

This application claims the benefit of Korean Patent Application No. 10-2006-103603, filed on Oct. 24, 2006, in the Korean Intellectual Property Office, the disclosure of which is incorporated herein in its entirety by reference.

FIELD OF THE INVENTION

The present invention relates to a high voltage transformer and, more particularly, to a high voltage transformer that can be fabricated with a small size and in a cost-effective manner, while minimizing stray capacitance generated between components of the high voltage transformer.

BACKGROUND OF THE INVENTION

A conventional high voltage transformer includes a magnetic core, a high voltage transforming part provided with a low voltage bobbin and a high voltage bobbin surrounding the magnetic core, a rectifying part for rectifying a high voltage current induced in the high voltage bobbin and then smoothing the rectified high voltage current, and a high voltage switch part. One of the points to be duly considered in fabricating the high voltage transformer is how to electrically insulate the components of the high voltage transformer with a view to reduce the volume and fabrication costs thereof.

One typical method of electrically insulating the components of the high voltage transformer is to arrange all the components within a transformer housing and then to fill the transformer housing with an insulating material. Examples of the insulating material used for this purpose include gaseous insulating materials, such as an air, oxygen, nitrogen, and hydrogen and liquid insulating materials, such as petroleum-based insulating oil, silicon oil and chlorinated oil.

Another typical method of electrically insulating the components of the high voltage transformer is to insert insulating bodies made of, e.g., plastics or glass, into between the components of the high voltage transformer.

Even if the components of the high voltage transformer are electrically insulated by filling the insulating material or inserting the insulating bodies as noted above, it is impossible to completely eliminate the stray capacitance generated between the components of the high voltage transformer. For this reason, the components of the high voltage transformer need to be arranged in a spaced-apart relationship in order to perfectly eliminate the stray capacitance.

The spacing between the components of the high voltage transformer varies with the magnitude of the voltage applied to the respective components. This means that the respective components should be spaced apart by a distance corresponding to the magnitude of the voltage applied thereto. Such an increase in the distance between the components of the high voltage transformer leads to an increased size and weight of the high voltage transformer, thereby making the transformer costly to fabricate.

SUMMARY OF THE INVENTION

In view of the above-noted and other problems inherent in the prior art, it is an object of the present invention to provide a high voltage transformer which is small-sized, lightweight and less costly to fabricate.

With this object in view, the present invention provides a high voltage transformer, comprising: a first transforming component group composed of a plurality of components including a magnetic core part, a high voltage transforming part, a high voltage switch part and a rectifying part; and a second transforming component group composed of a plurality of components including a magnetic core part, a high voltage transforming part, a high voltage switch part and a rectifying part. Each of the components of the first transforming component group and the second transforming component group has first and second opposite ends, the first end of each of the components of the first transforming component group being positioned opposite to the first end of each of the components of the second transforming component group. The components of the first transforming component group are adapted to operate at a voltage positively increasing from the first end to the second end of each of the components of the first transforming component group, the components of the second transforming component group being adapted to operate at a voltage negatively decreasing from the first end to the second end of each of the components of the second transforming component group. Each of the components of the first transforming component group is kept equipotential at the same distance measured from the first end of each of the components of the first transforming component group, each of the components of the second transforming component group being kept equipotential at the same distance measured from the first end of each of the components of the second transforming component group. An equal potential difference is maintained between the components of the first transforming component group and the components of the second transforming component group.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENTS

A high voltage transformer in accordance with the present invention will now be described in detail with reference to the accompanying drawings.

Figure 1:
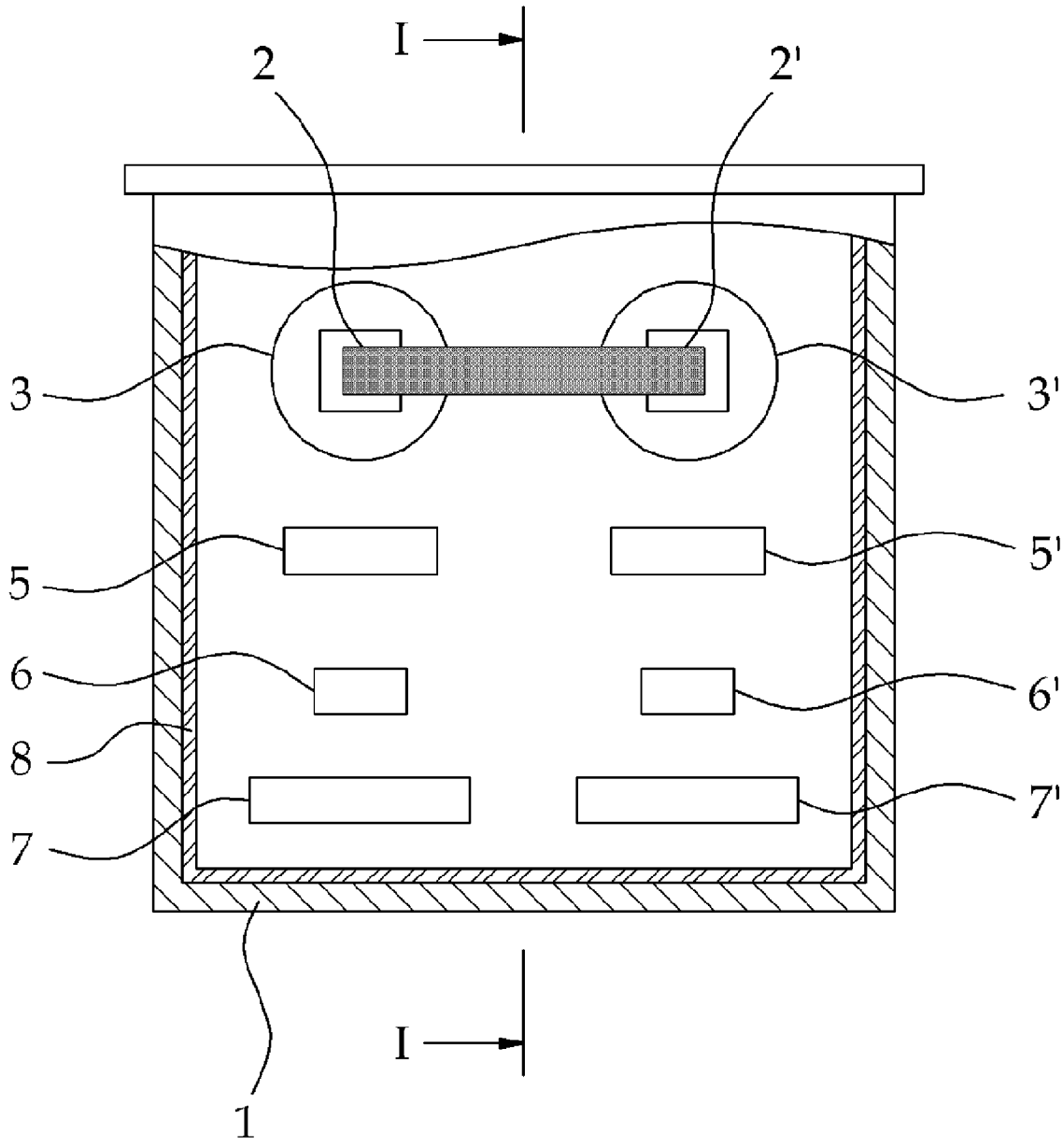
FIG. 1 is a top section view showing a high voltage transformer in accordance with one embodiment of the present invention.

FIG. 1 is a top section view showing a high voltage transformer in accordance with one embodiment of the present invention. Referring to FIG. 1, a high voltage transformer includes a housing 1, magnetic core parts 2 and 2', high voltage transforming parts 3 and 3', rectifying parts including rectifying diodes 5 and 5' and smoothing capacitors 6 and 6', and anode and cathode high voltage switch parts 7 and 7', all of which are received in the housing 1. The magnetic core parts 2 and 2', the high voltage transforming parts 3 and 3', the rectifying diodes 5 and 5', the smoothing capacitors 6 and 6' and the anode and cathode high voltage switch parts 7 and 7' are divided into first and second transforming component groups.

The first transforming component group consists of the magnetic core part 2, the high voltage transforming part 3, the rectifying diode 5, the smoothing capacitor 6 and the anode high voltage switch part 7. The first transforming component group is operable under a positive voltage. On the other hand, the second transforming component group consists of the magnetic core part 2', the high voltage transforming part 3', the rectifying diode 5', the smoothing capacitor 6' and the cathode high voltage switch part 7'. The second transforming component group is operable under a negative voltage.

Preferably, an insulating material 8 is attached to the inner surface of the housing 1 of the high voltage transformer. The insulating material 8 is made of, e.g., one of glass, fibers, resin and rubber.

Figure 2:
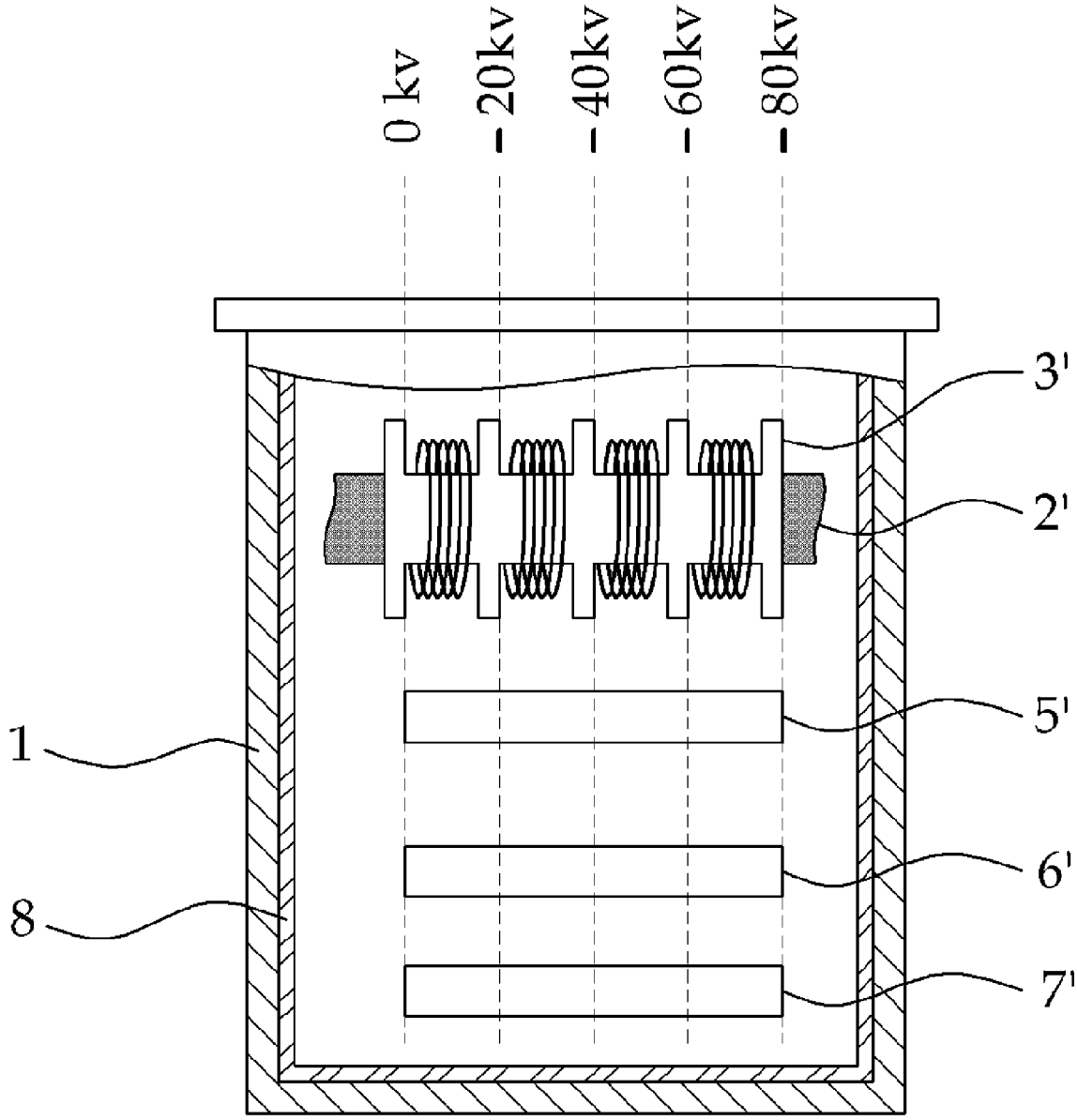
FIG. 2 is a side elevational section view of the high voltage transformer taken along line I-I in FIG. 1.

FIG. 2 is a side elevational section view of the high voltage transformer taken along line I-I in FIG. 1. Referring to FIG. 2, each of the components 2', 3', 5', 6' and 7' of the second transforming component group operable under the negative voltage has first and second opposite ends. The first end of each of the components 2', 3', 5', 6' and 7' of the second transforming component group remains electrically grounded. The components 2', 3', 5', 6' and 7' of the second transforming component group are operated at a voltage negatively and linearly decreasing by an equal decrement from the first end to the second end. For example, the operation voltage of the components 2', 3', 5', 6' and 7' is linearly decreased from 0 kv at the first end to −20 kv, −40 kv, −60 kv and then −80 kv at the second end.

Owing to the fact that all the components 2', 3', 5', 6' and 7' of the second transforming component group are equipotential at the same distance measured from the first ends thereof, no stray capacitance is generated between the components 2', 3', 5', 6' and 7' of the second transforming component group. Therefore, there is no need to use a separate insulating body for insulating the components 2', 3', 5', 6' and 7' of the second transforming component group, meaning that it is possible to arrange the components 2', 3', 5', 6' and 7' at a minimized spacing.

Similarly, each of the components 2, 3, 5, 6 and 7 of the first transforming component group operable under the positive voltage has first and second opposite ends. The first end of each component of the first transforming component group is positioned opposite to the first end of each component of the second transforming component group. The first end of each of the components 2, 3, 5, 6 and 7 of the first transforming component group remains electrically grounded. The components 2, 3, 5, 6 and 7 of the first transforming component group are operated at a voltage positively and linearly increasing by an equal increment from the first end to the second end. For example, the operation voltage of the components 2, 3, 5, 6 and 7 is linearly increased from 0 kv at the first end to 20 kv, 40 kv, 60 kv and then 80 kv at the second end.

Owing to the fact that all the components 2, 3, 5, 6 and 7 of the first transforming component group are equipotential at the same distance measured from the first ends thereof, no stray capacitance is generated between the components 2, 3, 5, 6 and 7 of the first transforming component group. Therefore, there is no need to use a separate insulating body for insulating the components 2, 3, 5, 6 and 7 of the first transforming component group, meaning that it is possible to arrange the components 2, 3, 5, 6 and 7 at a minimized spacing.

Figure 3:
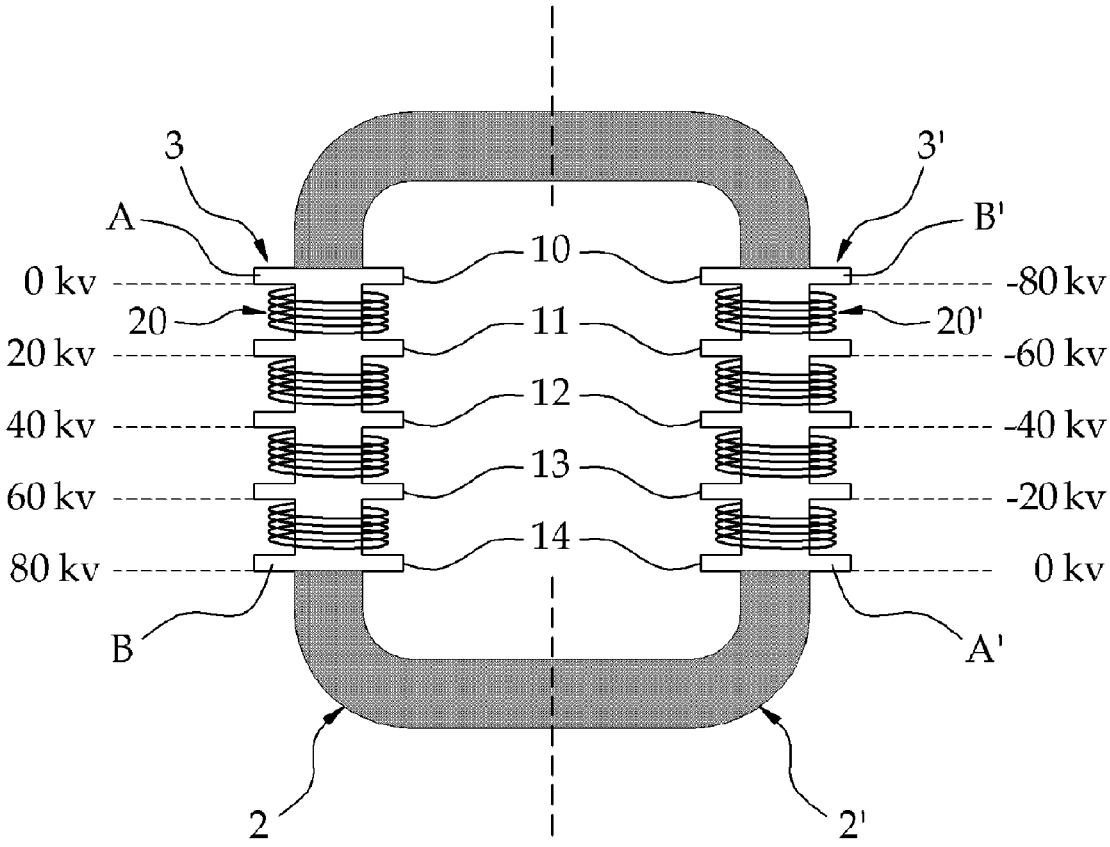
FIG. 3 illustrates the details of first and second transforming component groups of the high voltage transformer in accordance with one embodiment of the present invention.

FIG. 3 illustrates the details of the high voltage transforming part 3 and 3' which form the first and second transforming component groups of the high voltage transformer in accordance with one embodiment of the present invention. Referring to FIG. 3, the high voltage transformating part 3 and 3' are formed with primary coils, secondary coils and flanges. Primary coils (not shown) are wound on each one side of the magnetic core parts 2 and 2' and are surrounded by flanges 10, 11, 12, 13, 14. Secondary coils 20 and 20' are separately wound in the space made by each flanges 10, 11, 12, 13, 14.

The high voltage transforming part 3 of the first transforming component group arranged on the magnetic core part 2 has a first end A which remains electrically grounded. The high voltage transforming part 3 is operated at a voltage positively increasing from the first end A to a second end B. On the other hand, the high voltage transforming part 3' of the second transforming component group arranged on the magnetic core part 2' has a first end A' which remains electrically grounded. The high voltage transforming part 3' is operated at a voltage negatively decreasing from the first end A' to a second end B'. For example, the operation voltage of the high voltage transforming part 3 of the first transforming component group is linearly increased from the first end A to the second end B by an increment of 20 kv, while the operation voltage of the high voltage transforming part 3' of the second transforming component group is linearly decreased from the first end A' to the second end B' by a decrement of −20 kv.

The high voltage transforming part 3 of the first transforming component group and the high voltage transforming part 3' of the second transforming component group are arranged on the magnetic core parts 2 and 2' in a parallel relationship with each other. Therefore, the same potential difference is generated between the high voltage transforming part 3 of the first transforming component group and the high voltage transforming part 3' of the second transforming component group. For example, a potential difference of 80 kv is generated between the respective flanges 10, 11, 12 and 13 belonging to the high voltage transforming part 3 of the first transforming component group and the high voltage transforming part 3' of the second transforming component group.

All the components of the first transforming component group, including the high voltage transforming part 3, are equipotential at the same distance in the direction extending from the first end to the second end of the first transforming component group. Likewise, all the components of the second transforming component group, including the high voltage transforming part 3', are equipotential at the same distance in the direction extending from the first end to the second end of the second transforming component group. For the very reason, the same potential difference of 80 kv is generated between all the components of the first transforming component group and those of the second transforming component group.

As the same potential difference is kept between the components of the first transforming component group and those of the second transforming component group, no unwanted stray capacitance is generated therebetween. Thanks to this fact, there is no need to use a separate insulating body for insulating the components of the first and second transforming component groups. Furthermore, it becomes possible to arrange the components of the first and second transforming component groups at a minimized spacing.

Figure 4:
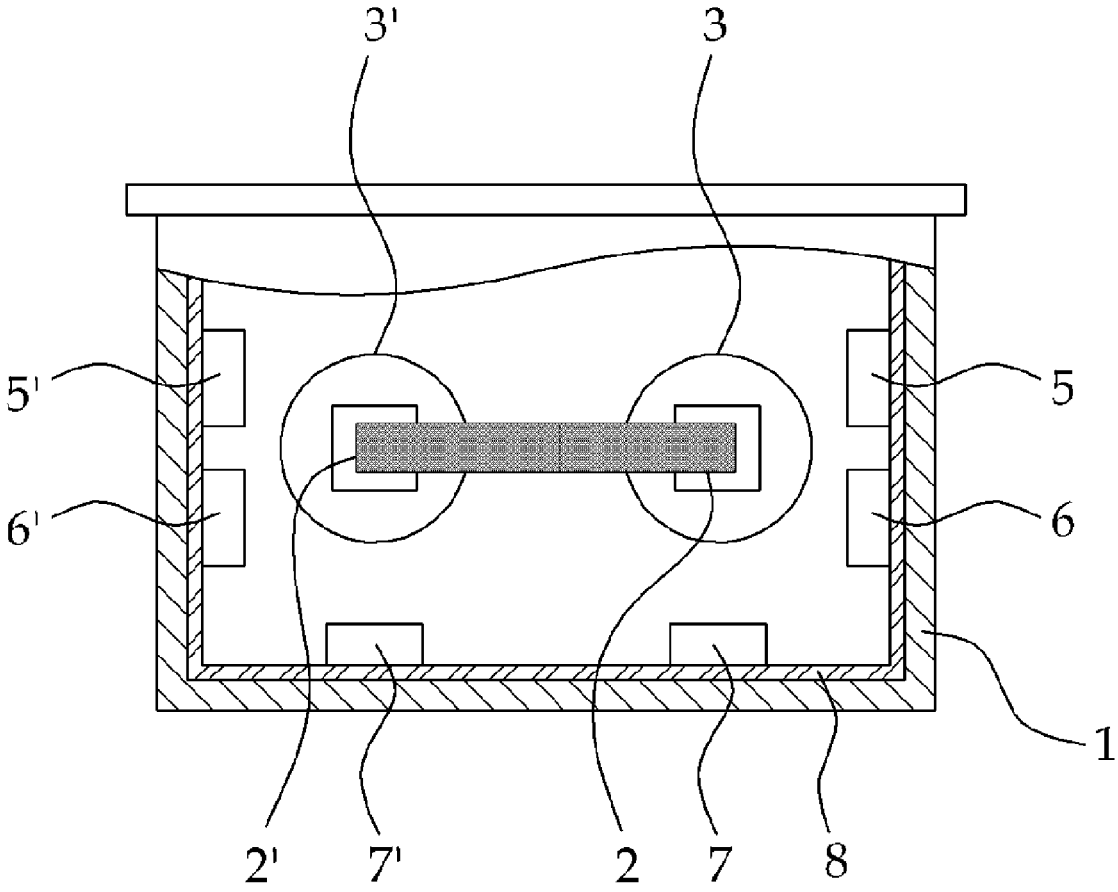
FIG. 4 is a top section view showing a high voltage transformer in accordance with another embodiment of the present invention.

FIG. 4 is a top section view showing a high voltage transformer in accordance with another embodiment of the present invention. Referring to FIG. 4, the components of the first and second transforming component groups are all received within the housing 1 of the high voltage transformer. The high voltage transforming part 3 of the first transforming component group is arranged symmetrically with respect to the high voltage transforming part 3' of the second transforming component group. Furthermore, the rectifying diodes 5 and 5', the smoothing capacitors 6 and 6' and the high voltage switch parts 7 and 7' are all positioned in proximity to the corresponding one of the high voltage transforming parts 3 and 3'.

As described hereinabove, the high voltage transformer in accordance with the present invention is designed to maintain equal the potential difference between the components of two transforming component groups and also to keep the components of the respective transforming component groups equipotential at the same distance in the direction extending from the first end to the second end. This eliminates the need to dispose an insulating body between the components of the first and second transforming component groups. This also makes it possible to fabricate the high voltage transformer with a small size and in a cost-effective manner.

The embodiments set forth hereinabove have been presented for illustrative purpose only and, therefore, the present invention is not limited to these embodiments. It will be understood by those skilled in the art that various changes and modifications may be made without departing from the scope of the invention defined in the claims.

What is claimed is:

1. A high voltage transformer, comprising:

a first transforming component group composed of a plurality of components including a magnetic core part, a high voltage transforming part, a high voltage switch part and a rectifying part; and a second transforming component group composed of a plurality of components including a magnetic core part, a high voltage transforming part, a high voltage switch part and a rectifying part, wherein each of the components of the first transforming component group and the second transforming component group has first and second opposite ends, the first end of each of the components of the first transforming component group being positioned opposite to the first end of each of the components of the second transforming component group, wherein the components of the first transforming component group are adapted to operate at a voltage positively increasing from the first end to the second end of each of the components of the first transforming component group, the components of the second transforming component group being adapted to operate at a voltage negatively decreasing from the first end to the second end of each of the components of the second transforming component group, wherein each of the components of the first transforming component group is kept equipotential at the same distance measured from the first end of each of the components of the first transforming component group, each of the components of the second transforming component group being kept equipotential at the same distance measured from the first end of each of the components of the second transforming component group, wherein an equal potential difference is maintained between the components of the first transforming component group and the components of the second transforming component group.

2. The high voltage transformer as recited in claim 1, wherein the positively increasing voltage of the components of the first transforming component group is linearly increased from the first end to the second end of each of the components of the first transforming component group, the negatively decreasing voltage of the components of the second transforming component group being linearly decreased from the first end to the second end of each of the components of the second transforming component group.

3. The high voltage transformer as recited in claim 1, wherein the components of the first transforming component group and the components of the second transforming component group are received within a housing in a mutually parallel relationship, the housing provided with an insulating liner.

4. The high voltage transformer as recited in claim 3, wherein the components of the first transforming component group and the components of the second transforming component group are equally spaced apart from the housing.

5. The high voltage transformer as recited in claim 1, wherein each of the rectifying parts of the first transforming component group and the second transforming component group includes a diode for rectifying a high voltage induced in each of the high voltage transforming parts of the first transforming component group and the second transforming component group and a smoothing capacitor for smoothing the high voltage rectified by the diode, the diode and the smoothing capacitor being arranged in proximity to each of the high voltage transforming parts of the first transforming component group and the second transforming component group.

* * * * *